US011532862B1

(12) United States Patent
Tabatabai et al.

(10) Patent No.: US 11,532,862 B1
(45) Date of Patent: Dec. 20, 2022

(54) HOUSING STRUCTURE FOR MAINTAINING ALIGNMENT BETWEEN CERAMIC SECTIONS OF A WAVEGUIDE FILTER

(71) Applicant: Meta Platforms, Inc., Menlo Park, CA (US)

(72) Inventors: Farbod Tabatabai, San Francisco, CA (US); Haris Alijagic, Livermore, CA (US)

(73) Assignee: Meta Platforms, Inc., Menlo Park, CA (US)

( * ) Notice: Subject to any disclaimer, the term of this patent is extended or adjusted under 35 U.S.C. 154(b) by 0 days.

(21) Appl. No.: 17/362,151

(22) Filed: Jun. 29, 2021

(51) Int. Cl.
*H01P 3/16* (2006.01)
*H01P 1/20* (2006.01)

(52) U.S. Cl.
CPC ..... *H01P 1/2002* (2013.01); *H01P 3/16* (2013.01)

(58) Field of Classification Search
CPC ..... H01P 1/2002; H01P 1/202; H01P 1/2053; H01P 1/2056; H01P 1/207; H01P 1/208; H01P 1/2082; H01P 1/2084; H01P 1/2086; H01P 1/2088; H01P 1/20; H01P 3/16; H01P 3/12; H01P 3/121; H01P 3/122
See application file for complete search history.

(56) References Cited

U.S. PATENT DOCUMENTS 6,097,270 A * 8/2000 Yamanobe ..... H01P 1/202 333/202
7,142,837 B1 11/2006 Small
9,437,908 B2 9/2016 Vangala
2005/0134404 A1* 6/2005 Kajiya ..... H01Q 25/004 333/156
2020/0252091 A1* 8/2020 Ondracek ..... H04B 1/40

OTHER PUBLICATIONS

Monolithic Integrated Ceramic Waveguide Filters, Muhammad Yameen Sandhu, Submitted in accordance with the requirements for the degree of Doctor of Philosophy, The University of Leeds, School of Electronic & Electrical Engineering. Jun. 2014.
Design of 60-GHz Vertically Stacked Waveguide Filters in LTCC, Tze-Ming Shen, Ting-Yi Hung, Chi-Feng Chen, and Ruey-Beei Wu, Department of Electrical Engineering and Graduate Institute of Communication Engineering, National Taiwan University, Taipei, Taiwan 106, R.O.C., APMC2005 Proceedings.
Advances on Microwave Ceramic Filters for Wireless Communications (Review Paper), Stelios Tsitsos, International Journal of Electrical and Computer Engineering (IJECE) vol. 8, No. 5, Oct. 2018, pp. 2762-2772.

* cited by examiner

*Primary Examiner* — Stephen E. Jones
(74) *Attorney, Agent, or Firm* — BakerHostetler

(57) ABSTRACT

Apparatuses, methods, and systems for a housing structure for maintaining alignment between ceramic sections of a bandpass filter are disclosed. One housing structure includes an L-shaped outer structure, a plurality of flexure portions, wherein at least one of flexure portion extends from an end portion of each of extended arms of the L-shaped outer structure, wherein each flexure portion extends inward perpendicular to each of the extended end portion, and a plurality of reference datums, wherein at least one reference datum is located between an L-joint of the L-shaped outer structure, and a one of the flexure portions. The housing structure operates to receive a plurality of sections of a waveguide filter, wherein each section includes a plurality of planar surfaces, wherein the datums and the flexure portions are operative to maintain alignment of the sections of the waveguide filter relative to each other.

19 Claims, 7 Drawing Sheets

HOUSING STRUCTURE FOR MAINTAINING ALIGNMENT BETWEEN CERAMIC SECTIONS OF A WAVEGUIDE FILTER

FIELD OF THE DESCRIBED EMBODIMENTS

The described embodiments relate generally to wireless communications. More particularly, the described embodiments relate to systems, methods, and apparatuses for a housing structure for maintaining alignment between ceramic sections of a ceramic filter.

BACKGROUND

High-performance bandpass filters are needed for wireless communication devices.

It is desirable to have methods, apparatuses, and systems for a housing structure for maintaining alignment between ceramic sections of a ceramic filter.

SUMMARY

An embodiment includes a housing structure. The housing structure includes an L-shaped outer structure, a plurality of flexure portions, wherein at least one of flexure portion extends from an end portion of each of extended arms of the L-shaped outer structure, wherein each flexure portion extends inward perpendicular to each of the extended end portion, and a plurality of reference datums, wherein at least one reference datum is located between an L-joint of the L-shaped outer structure, and a one of the flexure portions. The housing structure operates to receive a plurality of sections of a waveguide filter, wherein each section includes a plurality of planar surfaces, wherein the datums and the flexure portions are operative to maintain alignment of the sections of the waveguide filter relative to each other when the plurality of sections of the waveguide filter are inserted within the housing structure.

Another embodiment includes a remote radio unit (RRU). The RRU including one or more antennas, a downlink bandpass filter, and an uplink filter, wherein both the downlink bandpass filter and the uplink filter connected to the one or more antennas. At least one of the downlink bandpass filter and the uplink filter includes housing structure, the housing structure includes an L-shaped outer structure, a plurality of flexure portions, wherein at least one of flexure portion extends from an end portion of each of extended arms of the L-shaped outer structure, wherein each flexure portion extends inward perpendicular to each of the end portions, a plurality of reference datums, wherein at least one reference datum is located between an L-joint of the L-shaped outer structure, and a one of the flexure portions, and the housing structure operative to receive a plurality of sections of a waveguide filter, wherein each section includes a plurality of planar surfaces, wherein the datums and the flexure portions are operative to maintain alignment of the sections of the waveguide filter relative to each other when the plurality of sections of the waveguide filter are inserted within the housing structure.

Other aspects and advantages of the described embodiments will become apparent from the following detailed description, taken in conjunction with the accompanying drawings, illustrating by way of example the principles of the described embodiments.

DETAILED DESCRIPTION

The embodiments described include methods, apparatuses, and systems for a housing structure for maintaining alignment between ceramic sections of a bandpass filter.

Figure 1:
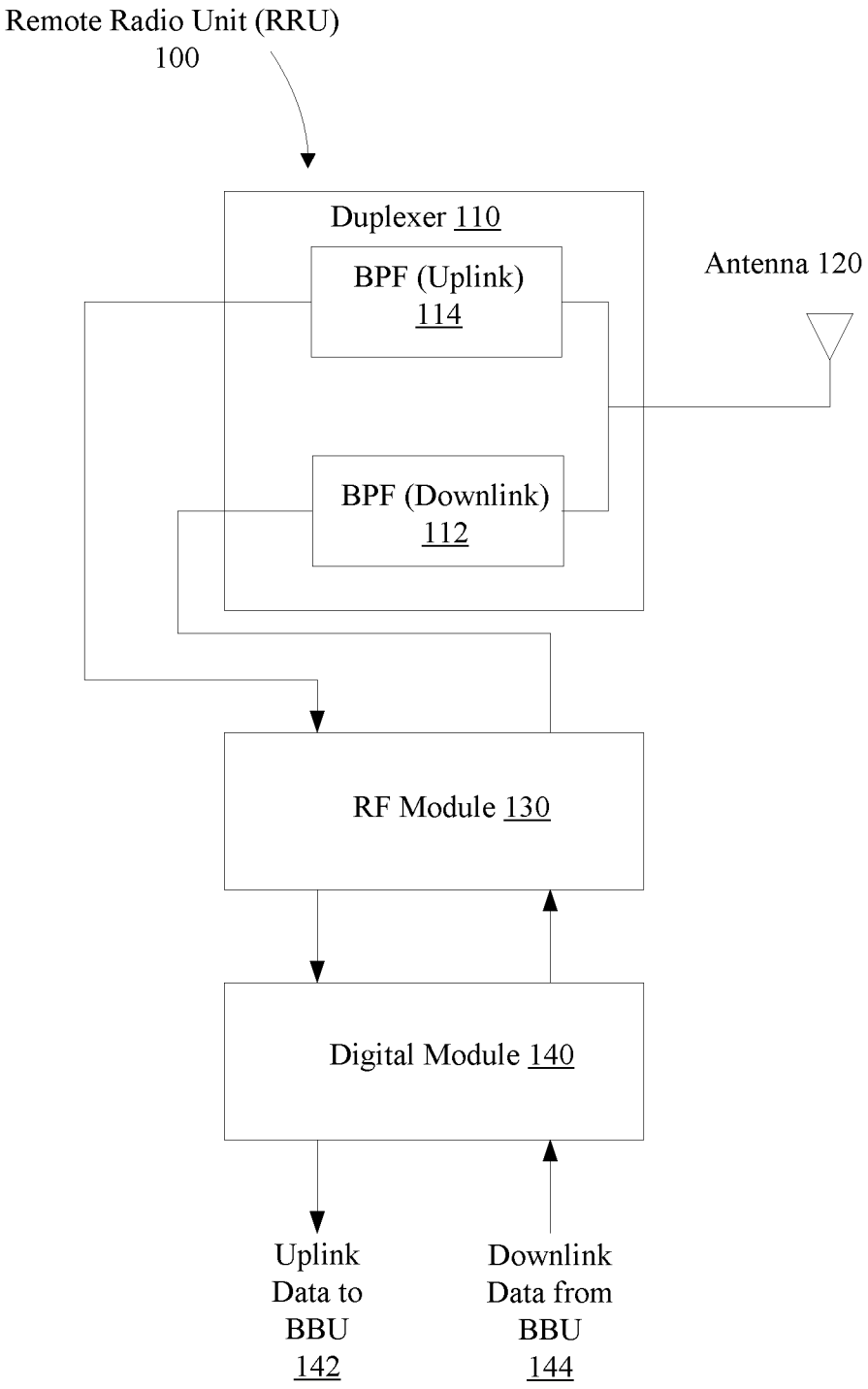
FIG. 1 shows a block diagram of a remote radio unit (RRU) that utilizes a bandpass filter, according to an embodiment.

FIG. 1 shows a block diagram of a remote radio unit (RRU) 100 that utilizes a bandpass filter, according to an embodiment. For an embodiment, the RRU 100 includes an antenna 120 (which can include an antenna array), a duplexer 110, an RF (radio frequency) module 130, and a digital module 140. For an embodiment, the RRU 100 facilitates wireless communication between a wireless device and a baseband unit (BBU).

For an embodiment, the duplexer 110 includes an uplink BPF (bandpass filter) 114 and a downlink BPF 112. The uplink BPF 114 filters wireless signals received from the wireless device before the received wireless signals are provided to the RF module 130. The downlink BPF 112 filter wireless signals before being transmitted by the RRU 100 to the wireless device.

The RF module 130 includes RF amplifiers, filters, and frequency down and up conversion circuitry. The digital module 140 include analog to digital converters (ADCs) for converting frequency the down-converted received wireless signals to digital signals (uplink data 142) for the BBU. The digital module 140 also includes digital to analog converters (DACs) for converting digital signals received from the BBU to analog signals to be frequency upconverted.

For at least some embodiments, the BPF 114 and/or the BPF 112 are implemented using a waveguide filter that includes ceramic sections. For at least some embodiments, a housing structure receives the ceramic sections of the waveguide filter and maintains a relative alignment between the ceramic sections.

Figure 2:
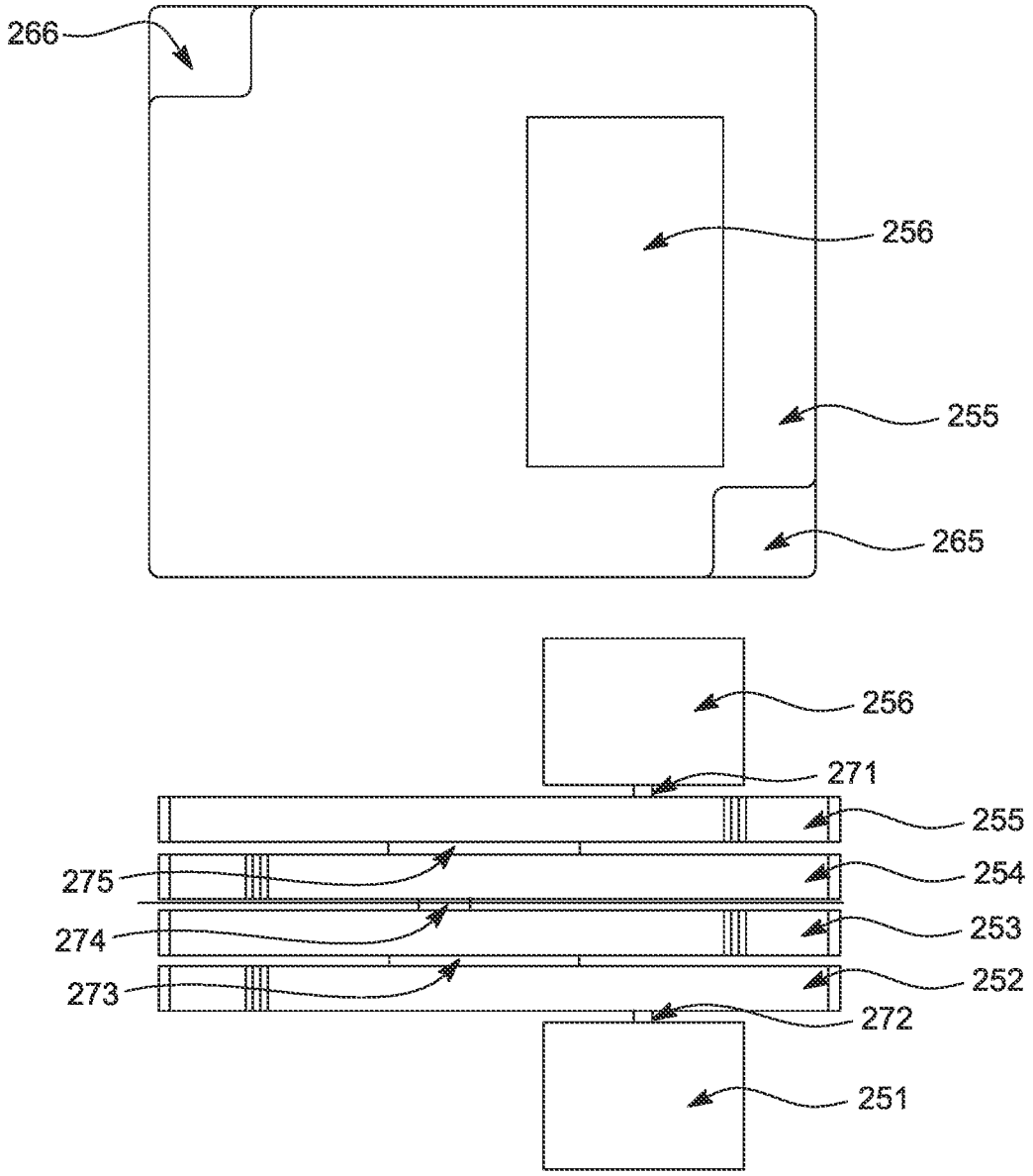
FIG. 2 shows ceramic sections of a waveguide filter that can utilize a housing structure for maintaining alignment between the ceramic sections, according to an embodiment.

FIG. 2 shows ceramic sections 252, 253, 254, 255 of a waveguide filter that can utilize a housing structure for maintaining alignment between the ceramic sections, according to an embodiment.

RF (radio frequency) cavity filters traditionally use air as a dielectric medium largely because of the ease and low cost of the filter manufacturing. However, these filters have significant downsides as they require anywhere from a half hour to an hour per filter of time for tuning. This requires highly skilled technicians and add significant cost to the filter implementation cost. Additionally, the size of the filter is proportional to the medium used for the RF wave to propagate through, and therefore leads to the entire product increasing is size and weight. Finally, in Remote Radio Units (RRU), widely used in the communication industry, the filter (such as the previously described uplink and downlink bandpass filters) is the largest single component and therefore drives the size and weight of the entire RRU. This is a significant cost driver in the industry. The miniaturization of this technology and the elimination of the need for filter tuning has a direct cost impact in the industry. It is possible to remove the tuning time of a cavity filter by designing a filter as a waveguide filter, however when air is used the volume of the filter is significantly large. By changing the medium/material of the filter to a material with a higher dielectric constant the size of the filter can be directly reduce. Combining these two methods of filter design it is possible to create a RF filter at a fraction of the size and cost of a traditional air cavity filter. The use of ceramics specifically allows for a significant reduction in size since ceramics with a dielectric constant of 30 or higher can be used, as opposed to air which has a dielectric constant of 1. The difficulty in using ceramics in waveguide filters lies in the difficulty in manufacturing and assembly, and more specifically in the inability of designs to incorporate such complex and miniature ceramic shapes into a housing that is cost effective to manufacture yet retains the high level of geometric size and tolerance required to maintain the performance of the ceramic waveguide filter. Thus far ceramic waveguide filters have been used in limited capacity, with the waveguide geometry largely designed in simple shapes as cylindrical or rectangular constant cross section geometries.

FIG. 2 shows a sample geometry of a highly effective ceramic cross coupling filter, designed to use ceramic (dielectric constant of 38) as the waveguide medium for a band 3 filter. Although extremely effective when modeled as an ideal geometry such a filter is difficult to manufacture and assemble with the high accuracies required to maintain the performance of the filter. The location and orientation of each feature is difficult to control since the part cannot be modified to using typical mechanical alignment features such as a hole slot in the part itself, since these features lead to unacceptable degradation in filter performance.

FIG. 2 show various views of ceramic sections of a waveguide filter that can be implemented as the BPFs 112, 114 of FIG. 1. As shown, the waveguide filter includes a series of ceramic sections (RF cavities) 252, 253, 254, 255 within which an RF signal propagates as the signal is filtered. For at least some embodiments, the ceramic sections 252, 253, 254, 255 include a dielectric constant greater than air.

As shown in FIG. 2, for an embodiment, the plurality of ceramic sections 252, 253, 254, 255 of the waveguide filter are aligned in series in parallel along a major axis (for example, the y-axis of FIG. 3), where adjacent pair of ceramic sections are coupled by a corresponding inter-section slot 273, 274, 275 by which an RF signal may pass from one ceramic section to another.

For an embodiment, each ceramic section 252, 253, 254, 255 may generally include a plurality of planar surfaces that define a first dimension aligned with the major axis (for example, along the y-axis), as well as a second dimension (for example, along the x-axis of FIG. 2) and a third dimension (for example, along the z-axis of FIG. 2) such that the second and third dimensions are aligned perpendicular to the major axis and each other. Further, for at least some embodiments, the first dimension of the ceramic section is shorter that the second dimension and the third dimension. Further, for at least some embodiments, the first dimension of each ceramic section is approximately one-twelfth of the wavelength ($\lambda/12$) of the RF signal to be passed by the waveguide filter. For an embodiment, the second and third dimensions are approximately equal to the wavelength $\lambda$. For an embodiment, each ceramic section 252, 253, 254, 255 may be characterized as approximating a narrow rectangular cuboid. For at least some embodiments, each two or more of the ceramic sections may posses slightly different first, second, and third dimensions based on different values of the wavelength $\lambda$, associated with the bandwidth to be passed by the waveguide filter. The waveguide filter of FIGS. 2 and 3 includes four ceramic sections 252, 253, 254, 255 resulting in a four-pole filter. However, other numbers of ceramic sections may be used.

Each of the ceramic sections may include a tuning notch 265, 266 that essentially occupies, fills, or walls off a corner to the ceramic section (such as, ceramic section 255 of FIG. 2). For an embodiment, each ceramic section 252, 253, 254, 255 includes two tuning notches representing cuboids located at diagonally opposing corner regions of the ceramic section. For an embodiment, a plane defined by the second and third dimensions of each ceramic section 252, 253, 254, 255 (that is, in the x-z plane of FIG. 2), each tuning notch may generally describe a square. Further, for at least some embodiments, each successive ceramic section 252, 253, 254, 255 includes tuning notches at alternating opposing corners of each ceramic section 252, 253, 254, 255.

Inter-ceramic slots 273, 274, 275 positioned between adjacent ceramic sections 252, 253, 254, 255 may be sized, shaped, and positioned relative to each other to create a zero transition between each pair of adjacent ceramic section 252, 253, 254, 255. For an embodiment, each zero transition may be associated with a particular frequency that defines the overall bandwidth of the signals passed through the waveguide.

For an embodiment, to direct an RF signal into the waveguide filter and produce a resulting filtered RF signal, and RF inlet 251 is provided to direct an incoming RF signal to the ceramic section 252. Further, for an embodiment, the filtered RF signal (having passed through all of the ceramic sections 252, 253, 254, 255) is directed from the last ceramic section 255 by way of an outlet slot 256.

Figure 3:
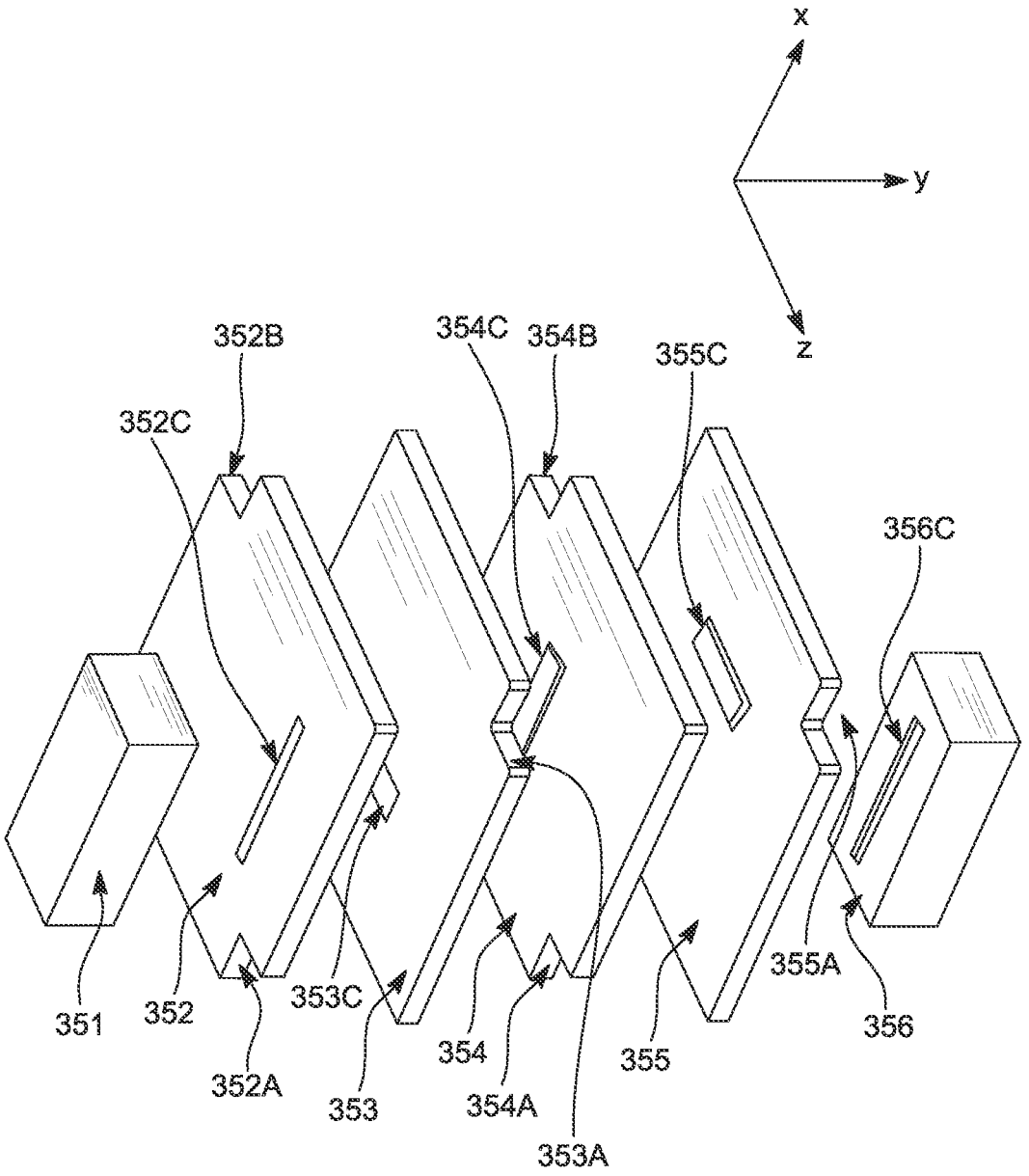
FIG. 3 shows ceramic sections of a waveguide filter that can utilize a housing structure for maintaining alignment between the ceramic sections, according to an embodiment.

FIG. 3 shows ceramic sections 352, 353, 354, 355 of a waveguide filter that can utilize a housing structure for maintaining alignment between the ceramic sections, according to an embodiment. Further, the waveguide filter includes inlet an outlet slots 351, 356.

As previously described, for an embodiment, each of the ceramic sections 352, 353, 354, 355 may include tuning notches 352A, 352B, 353A, 354A, 354B, 355A that essentially occupies, fills, or walls off a corner to the corresponding ceramic section 352, 353, 354, 355.

As previously described, for an embodiment, inter-ceramic slots 352C, 353C, 354C, 355C positioned between adjacent ceramic sections 352, 353, 354, 355 may be sized, shaped, and positioned relative to each other to create a zero transition between each pair of adjacent ceramic section 352, 353, 354, 355. For an embodiment, each zero transition may be associated with a particular frequency that defines the overall bandwidth of the signals passed through the waveguide. For an embodiment, the inter-ceramic slots 352C, 353C, 354C, 355C couple RF EM (electromagnetic) energy from one ceramic sections to another. The slot 356C of the RF outlet slot 356 and a slot of the RF input slot 351 operate to convert single mode TEM (transverse electromagnetic) energy to a dual mode.

The splitting the waveguide filter into individual ceramic section 352, 353, 354, 355 as shown in FIG. 3 allows for the manufacturing of each ceramic section at a low cost, but adds additional mechanical tolerance stack up when the individual sections are assembled to form the waveguide filter. As previously stated, the ceramic section 352, 353, 354, 355 must be precisely aligned, and the alignment needs to be maintained.

For an embodiment, aluminum (Al) is located between the ceramic section 352, 353, 354, 355. Further, for an embodiment, the aluminum is cutout at the slots between the ceramic section 352, 353, 354, 355. For an embodiment, the ceramic section 352, 353, 354, 355 are entirely metalized and aluminum is removed using a laser. The slots within the aluminum of the ceramic section 352, 353, 354, 355 need to be precisely aligned.

Figure 4:
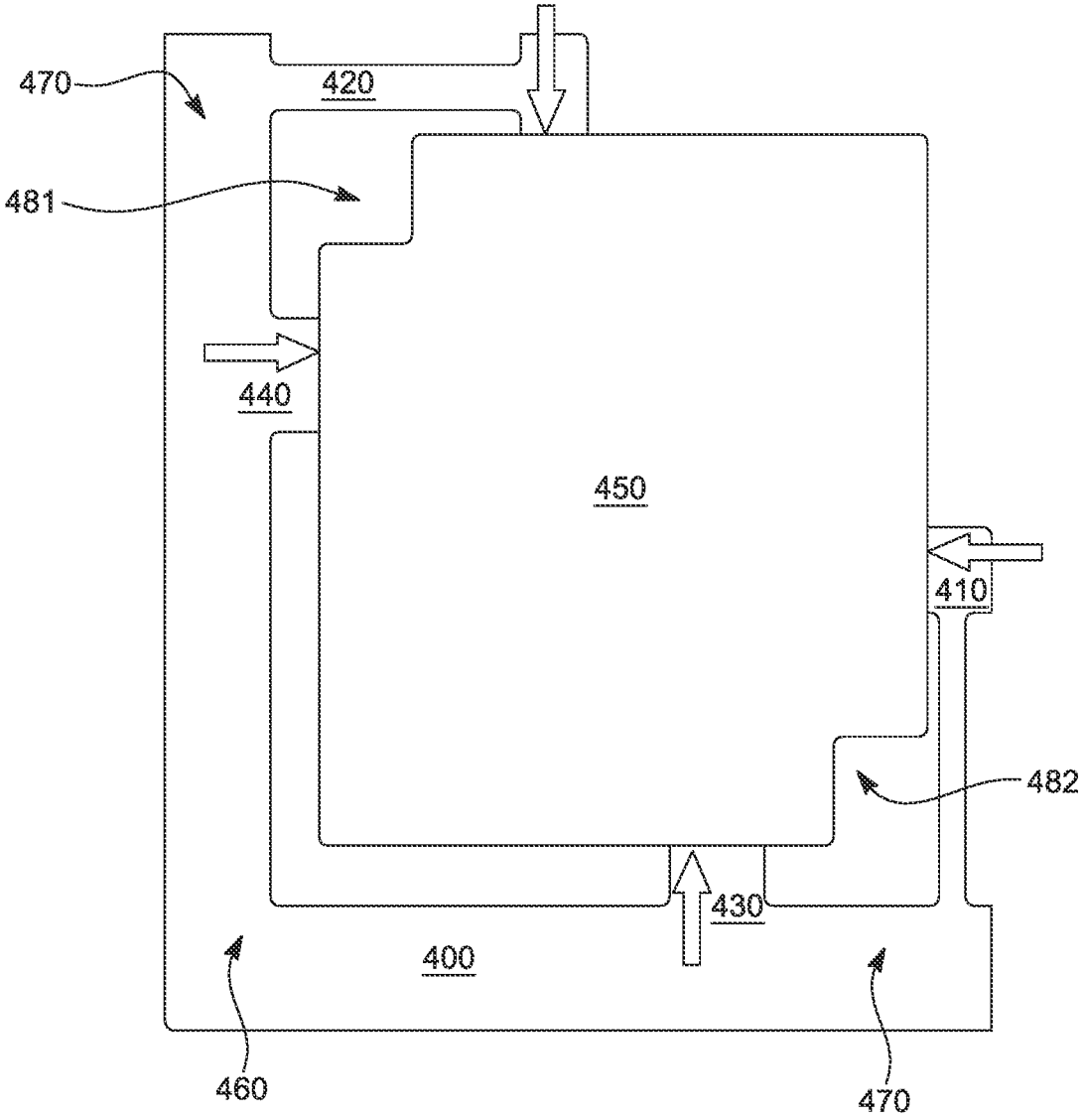
FIG. 4 shows a housing structure that holds and maintains alignment between ceramic sections of a waveguide filter, according to an embodiment.

FIG. 4 shows a housing structure 400 that holds and maintains alignment between ceramic sections 450 of a waveguide filter, according to an embodiment. For an embodiment, the housing structure 400 includes an L-shaped outer structure 470. For an embodiment, the housing structure further includes a plurality of flexure portions 410, 420, wherein at least one of flexure portion 410. 420 extends from an end portion of each of extended arms of the L-shaped outer structure 470, and wherein each flexure portion 410, 420 extends inward perpendicular to each of the end portions. For an embodiment, the housing structure further includes a plurality of reference datums 430, 440, wherein at least one reference datum 430, 440 is located between an L-joint 460 of the L-shaped outer structure 470, and a one of the flexure portions 410, 420. For an embodiment, the housing structure 400 operates to receive a plurality of sections of a waveguide filter (such as, ceramic section 450, wherein each section includes a plurality of planar surfaces, wherein the datums and the flexure portions are operative to maintain alignment of the sections of the waveguide filter relative to each other when the plurality of sections of the waveguide filter are inserted within the housing structure.

For an embodiment, the housing structure 400 includes an aluminum extruded housing section operating to fully constrain the ceramic waveguide sections. The housing structure 400 includes the flexure portions 410, 420. Further, the housing structure 400 includes the datums 430, 440. For an embodiment, the flexure portions 410, 420 operate as tunable and repeatable springs to provide the retaining force needed to accurately reference any given waveguide section to the datums 430, 440.

A first flexure portion 420 presses at least one of the ceramic sections 450 against the first datum 430, creating a plane-on-plane mate that constrains 3 degrees of freedom (DOF) of the at least one of the ceramic sections 450. That is, the pressing of the first flexure portion 420 on the at least one of the ceramic sections 450 against the first datum 430 prevents one translation degree of freedom and two rotational degrees of freedom.

A second flexure portion 410 presses the at least one of the ceramic sections against the second datum 440 to constrain 2 DOF, including one translational degree of freedom and one final rotational degree of freedom. The only remaining DOF is the translation in and out of the page, this DOF is constrained when the flexure portions 410, 420 are engaged since each flexure portion 410, 420 acts as a spring to force the sections(s) of ceramic waveguide against the datums 430, 440 of the housing 400 resulting in friction to prevent the part from sliding in or out of the housing 400.

For an embodiment, the spring force of the flexure portions 410, 420 can be tuned based on the material Young's Modulus, cross sectional area, flexure length and desired deflection to allow for a wide range of applications and geometries. The flexure design reduces the overall number or parts and processes that would otherwise need to be used to secure the filter section to the housing. Because each flexure portions 410, 420 acts as a spring, the flexure portions 410, 420 can be bent to allow greater clearance, allowing the filter body (ceramic sections) to be easily installed during an assembly or rework process.

Further, the flexure portions 410, 420 acting as a spring allows for the difference in thermal expansion of the dissimilar materials that may be used in fabricating each of the waveguide filter sections. For example, if the filter cavity (ceramic sections) is designed from ceramics with a linear thermal expansion coefficient around 8×10^−8/deg C. vs the supporting structure is designed from 6061 Al with a linear thermal expansion coefficient of about 20×10^−6/deg C. In this case during swings in the operating temperature and environmental conditions any passive retention system would not adequately retain the waveguide filter in its housing in the hot operating condition and cause unwanted stress on the ceramic part during the cold operating condition. By using the flexure portions 410, 420 to retain the ceramic sections in the housing location, the spring force can be tuned to the minimum (or at least below a threshold level) needed retention force at the hot operating condition and to prevent excessive stress concentrations within the ceramic material during the cold operating condition.

As previously described, for an embodiment, each of the plurality of sections of the waveguide filter includes a first dimension aligned with a major axis, and a second dimension and a third dimension that are aligned perpendicular to the major axis and each other, wherein the first dimension is shorter than the second dimension and the third dimension.

For an embodiment, the datums 430, 440 are aligned to be offset from corner cut-outs 481, 482 of the sections of the waveguide filter. For an embodiment, a one of the datums is oriented to be 90 degrees rotated relative to one other of the datums. For an embodiment, a single datum corresponds with the plurality of sections of the waveguide filter.

For an embodiment, a one of the flexure portions 410. 420 is oriented to be 90 degrees rotated relative to one other of the flexure portions 410. 420. For an embodiment, a one of the datums 430, 440 is oriented to be 180 degrees rotated relative a one of the flexure portions 410, 420. For an embodiment, each individual flexure 410, 420 constrains each section of the waveguide filter to a single reference datum of the datums 430, 440.

For an embodiment, a deflection property of each of the plurality of flexures 410, 420 is tuned based on a cross-section of the flexure 410, 420, and a flexure length (length of the flexure 410, 420). For an embodiment, a spring force of each of each of the flexures 410, 420 is selected to provide enough frictional force to prevent the sections of the waveguide filter from slipping along a surface of the housing structure, while allowing for installation of the sections during manufacturing. For an embodiment, the spring force of each of each of the flexures 410, 420 is selected to provide enough frictional force to prevent the sections of the waveguide filter from slipping along a surface of the housing structure when the housing structure is subjected to a temperature greater than a selected value.

Figure 5:
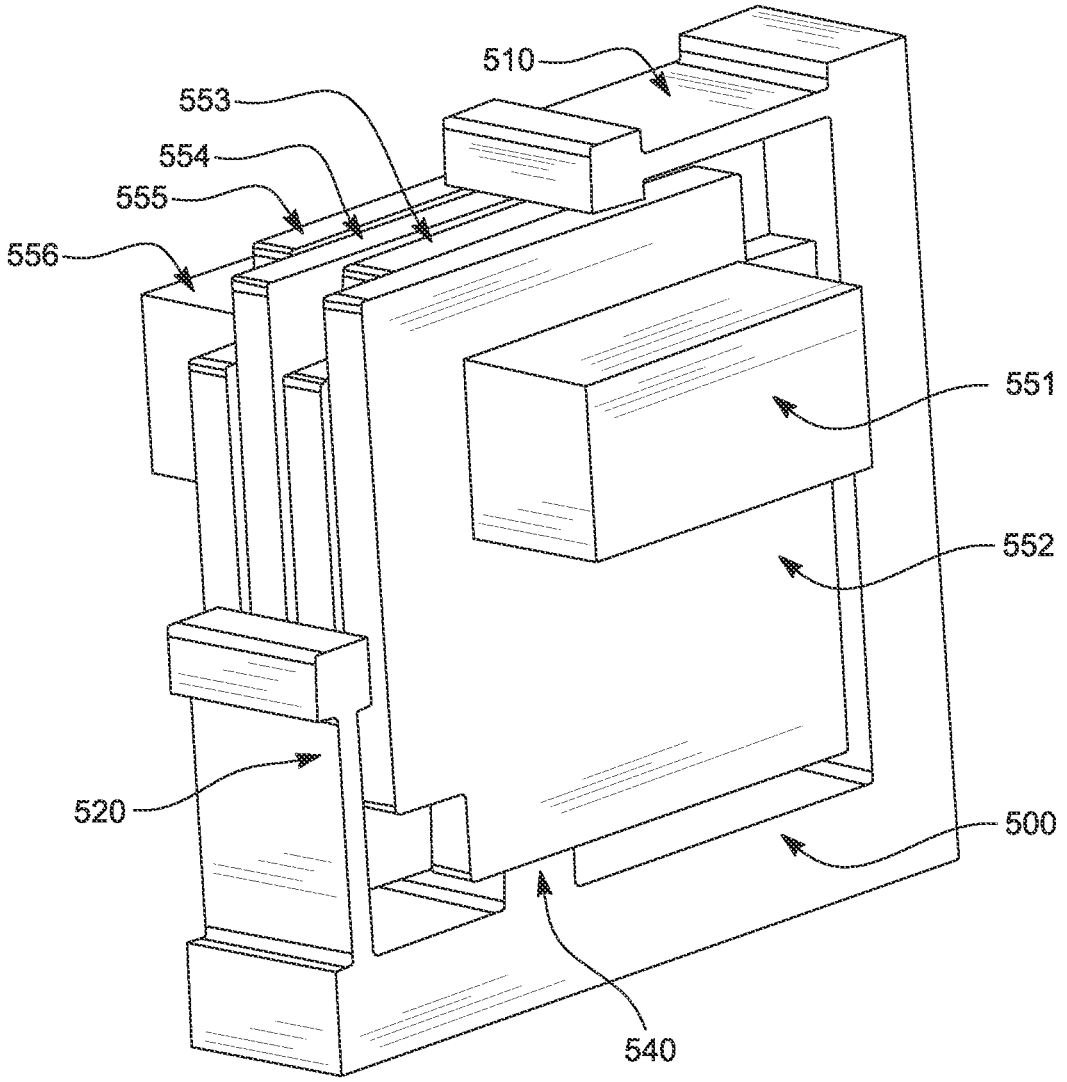
FIG. 5 shows another perspective of the housing structure that holds and maintains alignment between ceramic sections of the waveguide filter, according to an embodiment.

FIG. 5 shows another perspective of the housing structure 500 that holds and maintains alignment between ceramic sections 552, 553, 554, 555 of the waveguide filter, according to an embodiment. The perspective of the housing structure 500 of FIG. 5 illustrates a packaging/filter housing design that uses the principles of kinematic mounts to accurately place each of the ceramic sections 552, 553, 554, 555 into a proper location and orientation in respect to each the other ceramic sections 552, 553, 554, 555 and referenced to a single datum.

For the embodiment shown in FIG. 5, a pair of flexure portions 510, 520 operate to each constrain the plurality of ceramic sections 552, 553, 554, 555 relative to corresponding datums (such as, datum 540). The flexure portion do not constrain the RF inlet 551 or the RF outlet 556.

Figure 6:
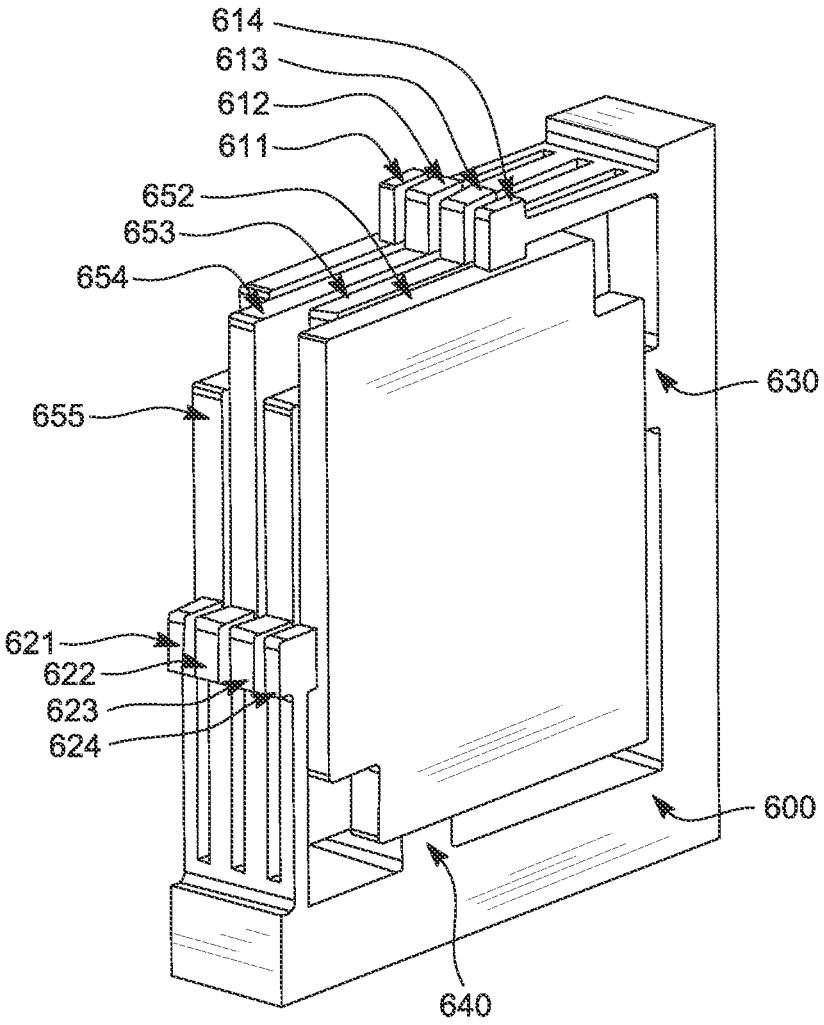
FIG. 6 shows a housing structure that holds and maintains alignment between ceramic sections of the filter that includes individual flexure portions for each ceramic section of the waveguide filter, according to an embodiment.

FIG. 6 shows a housing structure 600 that holds and maintains alignment between ceramic sections 652, 653, 654, 655 of the waveguide filter that includes individual flexure portions 611, 612, 613, 614, 621, 622, 623, 624 for each ceramic section 652, 653, 654, 655 of the waveguide filter, according to an embodiment. The flexure portions 611, 612, 613, 614 constrain the ceramic section 652, 653, 654, 655 to the single data 640, and the flexure portions 621, 622, 623, 624 constrain the ceramic section 652, 653, 654, 655 to the single data 630.

As shown, each end of the extended arms of the L-shaped outer structure includes the plurality of parallel flexure portions 611, 612, 613, 614, 621, 622, 623, 624, wherein a one of the plurality of flexure portions 611, 612, 613, 614, 621, 622, 623, 624 corresponds with each of the plurality of sections 652, 653, 654, 655 of the waveguide filter. For an embodiment, the different ceramic sections 652, 653, 654, 655 can have different width. For example, two outer ceramic sections 652, 655 can have one width, and two inner ceramic sections 653, 654 can have another width. For an embodiment, the parallel individual flexure portions 611, 612, 613, 614, 621, 622, 623, 624 can accommodate the varying widths of the ceramic sections by accordingly varying the widths of the flexure portions 611, 612, 613, 614, 621, 622, 623, 624.

The use of the flexure portions as constraints in housing structure is useful as it minimizes most of the undesirable effects of manufacturing such the sectional waveguide filter. Specifically, it allows for exact constraint design, ease of assembly (no fastening, low part count), thermal expansion of dissimilar materials and low cost (extrusion, casting or CNC machining processes possible). The housing structure that includes the flexure portions allows for each filter section to be referenced to a common datum for best positional accuracy and uses each individual flexure to retain the section securely in the housing.

Figure 7:
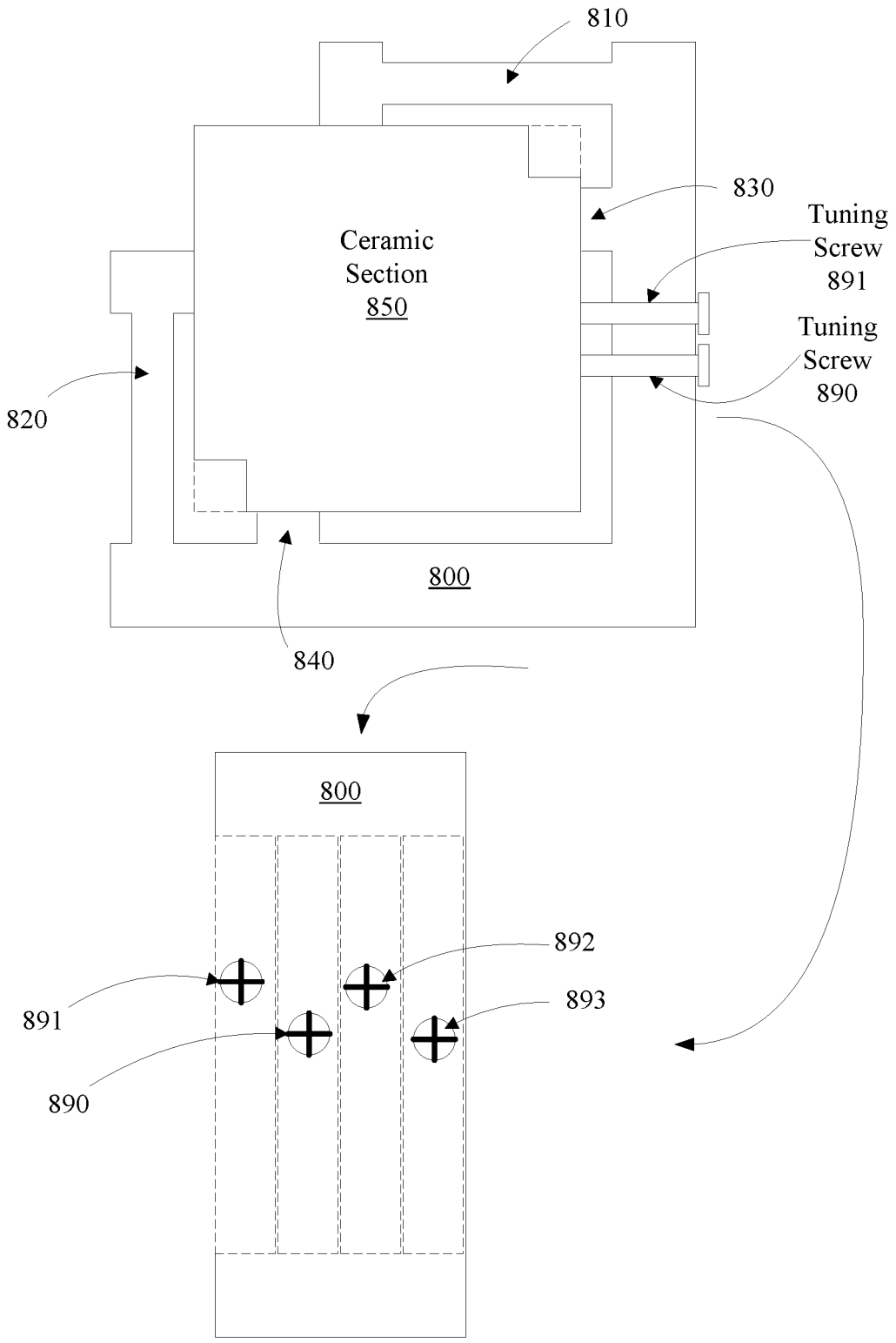
FIG. 7 shows a housing structure that includes tuning screws for adjusting an alignment of the ceramic sections of the waveguide filter, according to an embodiment.

FIG. 7 shows a housing structure 800 that includes tuning screws 890, 891, 892, 893 for adjusting an alignment of the ceramic sections of the waveguide filter, according to an embodiment. For an embodiment, heads of the tuning screws are located on an outside surface of the of the housing 800 where heads of the tuning screws 890, 891, 892, 893 are accessible for tuning the alignment of the ceramic sections 850, which tunes the frequency response of the waveguide filter.

For an embodiment, the housing structure 800 includes tuning screws 890, 891, 892, 893 located on an outer surface of the L-shaped outer structure, wherein the outer surface is parallel and opposite to a surface of the L-shaped outer structure in which one of the datums 830 is located. For an embodiment, the tuning screws 890, 891, 892, 893 extend through the L-shaped outer structure. Adjustment of the screws adjusts an alignment of the ceramic sections relative to each other. Accordingly, adjustment of the tuning screws provides adjustment of the frequency response of the waveguide filter. The housing structure 800 further includes the datum 840 and the flexures 810, 820.

For an embodiment, the housing structure is configured to enclose (fix the position and alignment) of multiple waveguide filters. For example, a single housing can be configured to maintain the placement of uplink and downlink bandpass filters 112, 114 of FIG. 1. The input/output of the pair of filters being connected as shown in FIG. 1.

Further, for an embodiment, the housing structure can be configured to hold multiple waveguide filters. The multiple filters can be connected in series to provide greater out-of-band filtering than a single filter.

Although specific embodiments have been described and illustrated, the embodiments are not to be limited to the specific forms or arrangements of parts so described and illustrated. The described embodiments are to only be limited by the claims.

What is claimed:

1. A housing structure, comprising an L-shaped outer structure;

a plurality of flexure portions, wherein at least one of the flexure portions extends from an end portion of each of extended arms of the L-shaped outer structure, wherein each flexure portion extends inward perpendicular to each of the end portions;

a plurality of reference datums, wherein at least one reference datum is located between an L-joint of the L-shaped outer structure, and a one of the flexure portions; and the housing structure operative to receive a plurality of sections of a waveguide filter, wherein each section includes a plurality of planar surfaces;

wherein the datums and the flexure portions are operative to maintain alignment of the sections of the waveguide filter relative to each other when the plurality of sections of the waveguide filter are inserted within the housing structure.

2. The housing structure of claim 1, wherein each of the plurality of sections includes a first dimension aligned with a major axis, and a second dimension and a third dimension that are aligned perpendicular to the major axis and each other;

wherein the first dimension is shorter than the second dimension and the third dimension.

3. The housing structure of claim 1, wherein the datums are aligned to be offset from corner cut-outs of the sections of the waveguide filter.

4. The housing structure of claim 1, wherein a one of the datums is oriented to be 90 degrees rotated relative to one other of the datums.

5. The housing structure of claim 1, wherein a one of the flexure portions is oriented to be 90 degrees rotated relative to one other of the flexure portions.

6. The housing structure of claim 1, wherein a one of the datums is oriented to be 180 degrees rotated relative a one of the flexure portions.

7. The housing structure of claim 1, wherein the housing structure includes an aluminum extruded housing.

8. The housing structure of claim 1, wherein the housing structure further comprises tuning screws located on an outer surface of the L-shaped outer structure, wherein the outer surface is parallel and opposite to a surface of the L-shaped outer structure in which one of the datums is located.

9. The housing structure of claim 8, wherein the tuning screws operate to adjust the alignment between each of the plurality of sections of the waveguide filter.

10. The housing structure of claim 8, wherein tuning the tuning screws operates to adjust a frequency response of the waveguide filter.

11. The housing structure of claim 1, wherein each individual flexure constrains each section of the waveguide filter to a single reference datum.

12. The housing structure of claim 11, wherein a deflection property of each of the plurality of flexures is tuned based on a cross-section of the flexure, and a flexure length.

13. The housing structure of claim 11, wherein a spring force of each of each of the flexures is selected to provide enough frictional force to prevent the sections of the waveguide filter from slipping along a surface of the housing structure, while allowing for installation of the sections during manufacturing.

14. The housing structure of claim 11, wherein a spring force of each of each of the flexures is selected to provide enough frictional force to prevent the sections of the waveguide filter from slipping along a surface of the housing structure when the housing structure is subjected to a temperature greater than a selected value.

15. The housing structure of claim 1, wherein each end of the extended arms of the L-shaped outer structure comprises a plurality of parallel flexure portions, wherein a one of the plurality of flexure portions corresponds with each of the plurality of sections of the waveguide filter.

16. The housing structure of claim 15, wherein a single datum corresponds with the plurality of sections of the waveguide filter.

17. The housing structure of claim 1, wherein the housing structure is further operative to receive a plurality of sections of a plurality waveguide filters.

18. The housing structure of claim 17, wherein one of the plurality of waveguide filters operates to receive and filters received wireless signals of a remote radio unit (RRU), and another of the plurality of waveguide filters operates to filter transmit wireless signals of the RRU.

19. A remote radio unit (RRU) comprising:

one or more antennas;

a downlink bandpass filter and an uplink filter, wherein both the downlink bandpass filter and the uplink filter are connected to the one or more antennas;

wherein at least one of the downlink bandpass filter and the uplink filter includes a housing structure, the housing structure comprising:

an L-shaped outer structure;

a plurality of flexure portions, wherein at least one of the flexure portions extends from an end portion of each of extended arms of the L-shaped outer structure, wherein each the plurality of flexure portion extends inward perpendicular to each of the end portions;

a plurality of reference datums, wherein at least one reference datum is located between an L-joint of the L-shaped outer structure, and a one of the flexure portions; and the housing structure operative to receive a plurality of sections of a waveguide filter, wherein each section includes a plurality of planar surfaces;

wherein the datums and the flexure portions are operative to maintain alignment of sections of the waveguide filter relative to each other when the plurality of sections of the waveguide filter are inserted within the housing structure.

* * * * *